US008858371B2

(12) United States Patent
Rockoff

(10) Patent No.: US 8,858,371 B2
(45) Date of Patent: Oct. 14, 2014

(54) LIGHT'EM UP: FOOTBALL QB TRAINER

(76) Inventor: Andrew Rockoff, Florham Park, NJ (US)

( * ) Notice: Subject to any disclaimer, the term of this patent is extended or adjusted under 35 U.S.C. 154(b) by 120 days.

(21) Appl. No.: 13/463,388

(22) Filed: May 3, 2012

(65) Prior Publication Data

US 2013/0012339 A1 Jan. 10, 2013

Related U.S. Application Data

(60) Provisional application No. 61/504,892, filed on Jul. 6, 2011.

(51) Int. Cl.

| | |
|---|---|
| ***A63B 69/00*** | (2006.01) |
| ***A63B 63/00*** | (2006.01) |
| *A63B 24/00* | (2006.01) |

(52) U.S. Cl.

CPC ..... *A63B 63/00* (2013.01); *A63B 2225/54* (2013.01); *A63B 2243/007* (2013.01); *A63B 2220/20* (2013.01); *A63B 2220/805* (2013.01); *A63B 2225/50* (2013.01); *A63B 2220/64* (2013.01); *A63B 2024/0037* (2013.01); *A63B 2220/833* (2013.01); *A63B 69/0053* (2013.01)

USPC ..... 473/476; 473/422

(58) Field of Classification Search

USPC ..... 473/476, 422; 273/375

See application file for complete search history.

(56) References Cited

U.S. PATENT DOCUMENTS

| | | | | |
|---|---|---|---|---|
| 1,223,519 | A * | 4/1917 | Reed et al. | 273/375 |
| 3,810,618 | A | 5/1974 | Nedwick | |
| 4,029,315 | A | 6/1977 | Bon | |
| 4,607,842 | A * | 8/1986 | Daoust | 473/446 |
| 4,936,578 | A | 6/1990 | Hudson, Sr. | |
| 5,064,195 | A * | 11/1991 | McMahan et al. | 473/480 |
| 5,224,699 | A * | 7/1993 | Zaruba | 273/375 |
| 5,326,094 | A * | 7/1994 | Quinn | 273/371 |
| 5,509,650 | A | 4/1996 | MacDonald | |
| 5,688,196 | A | 11/1997 | O'Neil | |
| 6,575,851 | B1 * | 6/2003 | Lamberti et al. | 473/435 |
| 7,134,976 | B1 * | 11/2006 | Smith | 473/446 |
| 7,341,529 | B2 | 3/2008 | Bayduke | |

(Continued)

FOREIGN PATENT DOCUMENTS

HU WO 99/07447 A1 2/1999

OTHER PUBLICATIONS

Video Clip; Internet site—http://espn.go.com/high-school/football/video/clip?id=6598525; Letter to ESPN dated Apr. 3, 2013.
Letter from ESPN dated Apr. 29, 2013.

*Primary Examiner* — Gene Kim
*Assistant Examiner* — M Chambers
(74) *Attorney, Agent, or Firm* — Gearhart Law, LLC

(57) ABSTRACT

A sports training system having at least two target stations, each target station having a target support structure configured to support a target in a stationary position above a playing field, at least one light attached to the target in a vicinity of a periphery of the target, a target control module functionally connected to the target light, an activation control module located remotely from the target stations and in wireless communication with the target control module. The activation control module and the target control modules are configured and programmed so that activating a button on the activation control module results in activating a randomly selected target light on a randomly selected target station.

15 Claims, 7 Drawing Sheets

(56) References Cited

U.S. PATENT DOCUMENTS

| | | | | |
|---|---|---|---|---|
| 7,661,679 | B2 * | 2/2010 | Mah et al. | 273/371 |
| 7,850,551 | B2 | 12/2010 | Barber | |
| 7,999,694 | B2 * | 8/2011 | Martin et al. | 340/815.4 |
| 8,016,687 | B2 * | 9/2011 | Martin et al. | 473/24 |
| 2004/0063521 | A1 * | 4/2004 | Oister et al. | 473/476 |
| 2005/0200079 | A1 | 9/2005 | Barber | |
| 2006/0148599 | A1 | 7/2006 | Haddix | |
| 2007/0191141 | A1 * | 8/2007 | Weber | 473/446 |
| 2008/0132361 | A1 | 6/2008 | Barber | |
| 2008/0189447 | A1 | 8/2008 | Hoch et al. | |
| 2009/0075764 | A1 | 3/2009 | Zedick, Sr. et al. | |
| 2009/0280931 | A1 | 11/2009 | Barber | |
| 2013/0012339 | A1 * | 1/2013 | Rockoff | 473/422 |

* cited by examiner

LIGHT'EM UP: FOOTBALL QB TRAINER

CLAIM OF PRIORITY

This application claims priority to U.S. Provisional Application 61/504,892, filed Jul. 6, 2011, the contents of which are fully incorporated herein by reference.

FIELD OF THE INVENTION

The present invention relates generally to a sports training apparatus, and more particularly, to a sports training apparatus providing target practice.

BACKGROUND

One of the most effective and dangerous offensive weapons a football team can have is a quarterback that can pass quickly and accurately. A quarterback must be able to survey the field and make a quick computation to determine his best course of action. Any given passing play has several different receivers designated as options, and with opposing pass rushers flying through the line in a matter of seconds, the quarterback needs to quickly but thoroughly scan the field and read the defense, decide where to throw or run, and then execute his decision. Other sports also require speed and accuracy in getting a ball to a certain position on a field. It is therefore desirable to have a sports training apparatus to help athletes develop and hone such skills.

SUMMARY

The invention is a sports training system having at least two target stations, each target station comprising a target support structure configured to support a target in a stationary position above a playing field, at least one light fixedly attached to said target in a vicinity of a periphery of the target, a target control module functionally connected to said target light, an activation control module located remotely from said target stations and in wireless communication with said target control module, and wherein said activation control module and said target control modules are configured and programmed such that activating a button on the activation control module results in activating a randomly selected target light on a randomly selected target station.

DETAILED DESCRIPTION

Figure 1:
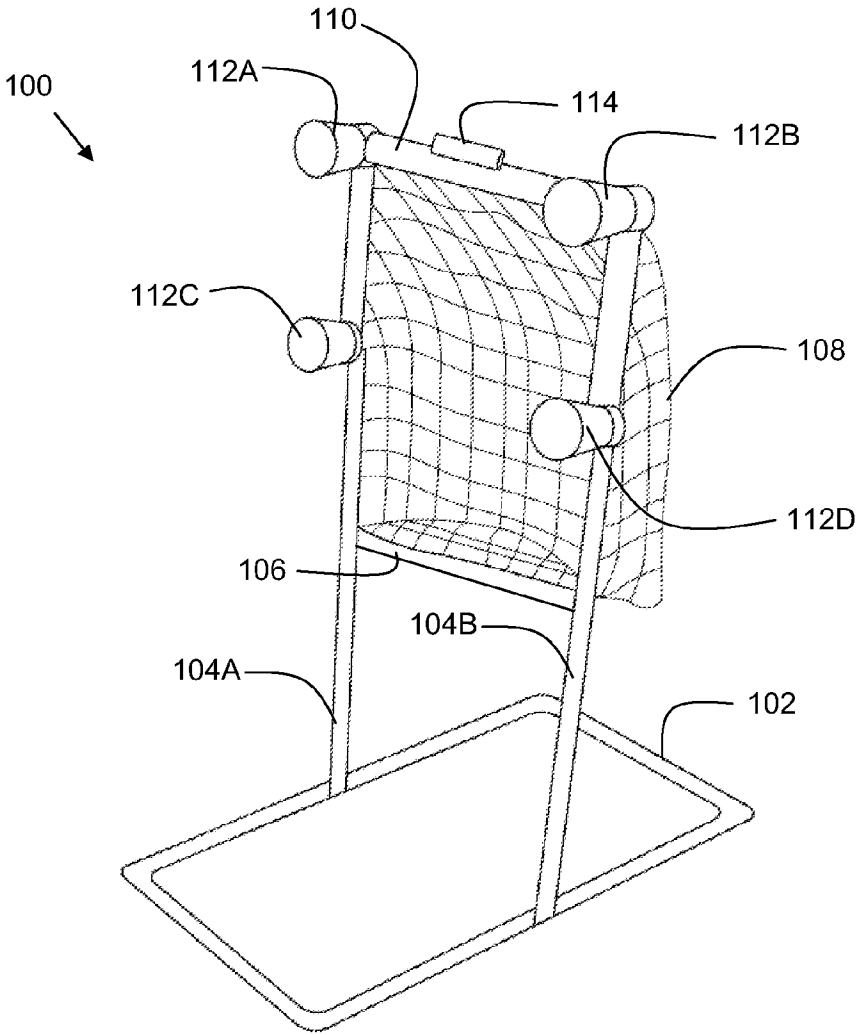
FIG. 1 shows a perspective view of an apparatus in accordance with an embodiment of the present invention.

FIG. 1 shows a perspective view of a sports training apparatus 100 in accordance with an embodiment of the present invention. Sports training apparatus 100 comprises a base 102 which supports vertical members 104A and 104B. In between vertical member 104A and vertical member 104B is lower spar 106 and upper spar 110. Together, vertical members 104A and 104B, and lower spar 106 and upper spar 110 comprise a target support structure to which net 108 is attached. Affixed to each vertical member (referred to generally as 104) are two lights (112A-112D). Mounted on upper spar 110 is target control module 114 which may comprise a target sensor interface, a controller, and a communications transceiver. Sports training apparatus 100 may also be referred to as a "target station."

Figure 2:
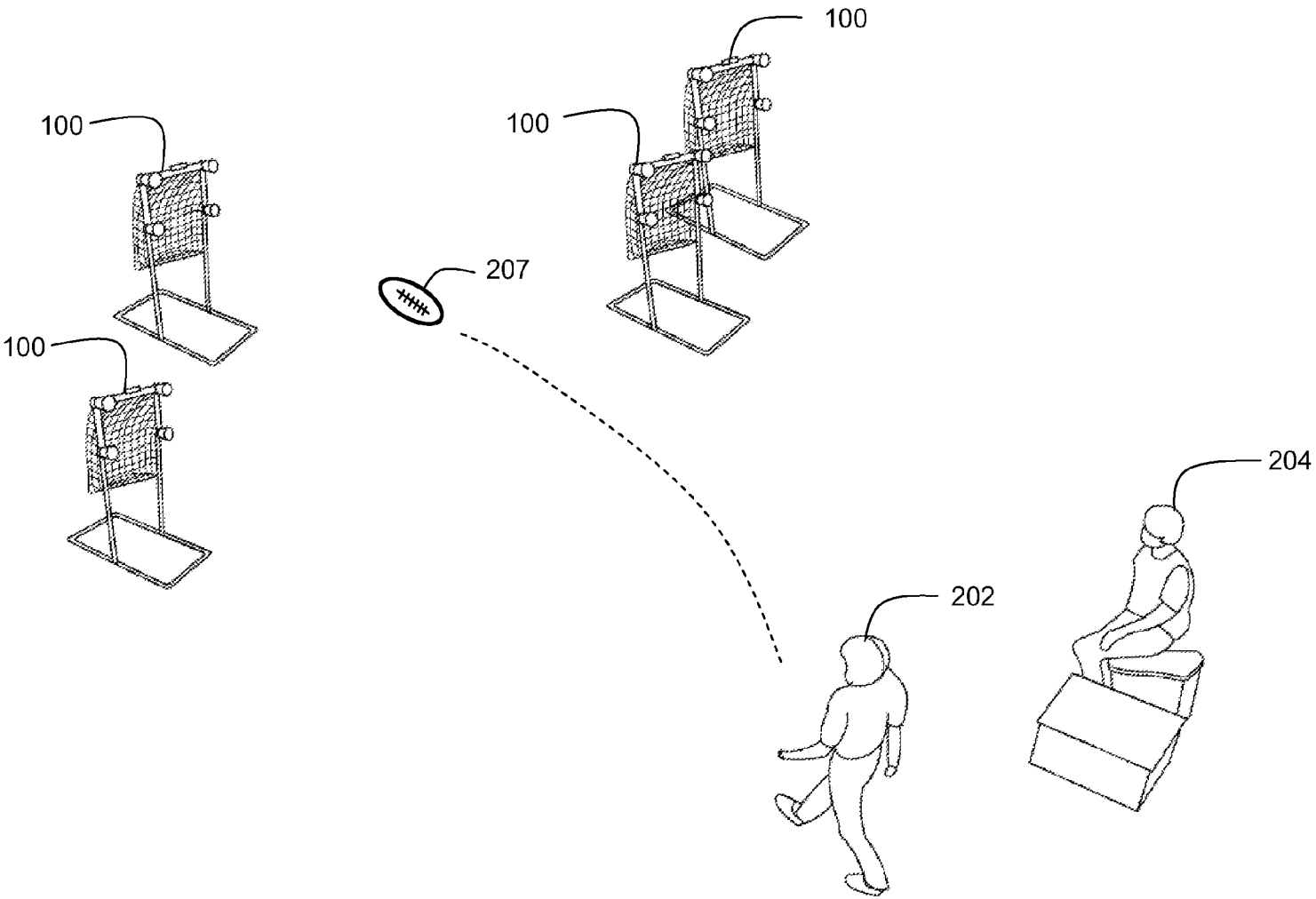
FIG. 2 shows an example of an embodiment of the present invention in use.

FIG. 2 shows an example of an embodiment of the present invention in use. Multiple sports training apparatuses 100 are placed at various locations within a practice area (such as a football field). An athlete 202 can then practice getting a ball 207 into the net of the various sports training apparatuses 100 at various times. For example, athlete 202 may be a football quarterback, in which case, the athlete 202 attempts to throw a football into the sports training apparatuses 100 at various times. The lights 112A-112D illuminate to prompt the athlete 202 to throw the football into the target. In one embodiment, a coach 204 may remotely control the plurality of sports training apparatuses 100 via a remote control. In this way, the coach 204 can control when each sports training apparatus (STA) illuminates its lights 112A-112D. During a training exercise, an illuminated STA 100 is representative of an open receiver. The athlete practices by reviewing the practice area in an attempt to quickly identify an open receiver and then quickly get the football into the target. Thus, the quarterback's observational skills, throwing speed, and throwing accuracy can be assessed and improved using embodiments of the present invention. Note that while the previous example pertained to a football quarterback, other sports may also be practiced with embodiments of the present invention. For example, athlete 202 may be a soccer player, such as a fullback or midfielder that practices kicking a ball into the STA 100. Alternatively, athlete 202 may be a soccer goalkeeper, in which case he practices throwing a soccer ball into the STA 100. Most any sport that involves a ball may be used with an embodiment of the present invention, including, but not limited to, baseball, basketball, rugby, and lacrosse.

Figure 3:
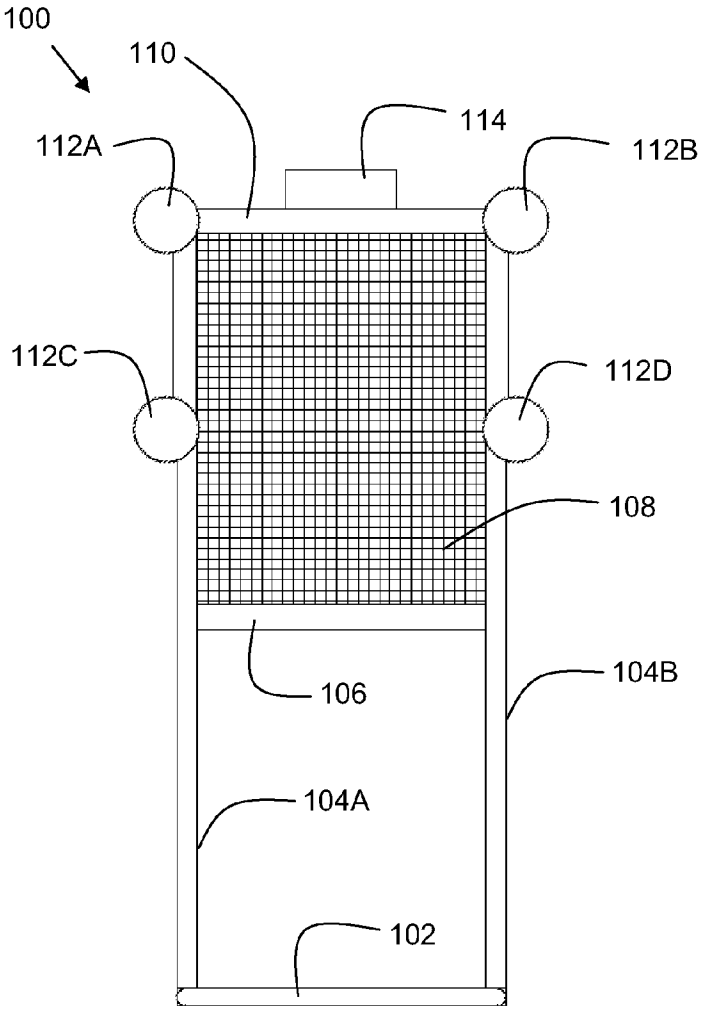
FIG. 3 shows a front view of an embodiment of the present invention.

FIG. 3 shows a front view of STA 100. In this view, four lights 112A-112D are visible. Other embodiments may have more or fewer lights. Also shown in FIG. 3 are base 102, vertical members 104A and 104B, lower spar 106, upper spar 110, net 108, and target control module 114.

Figure 4:
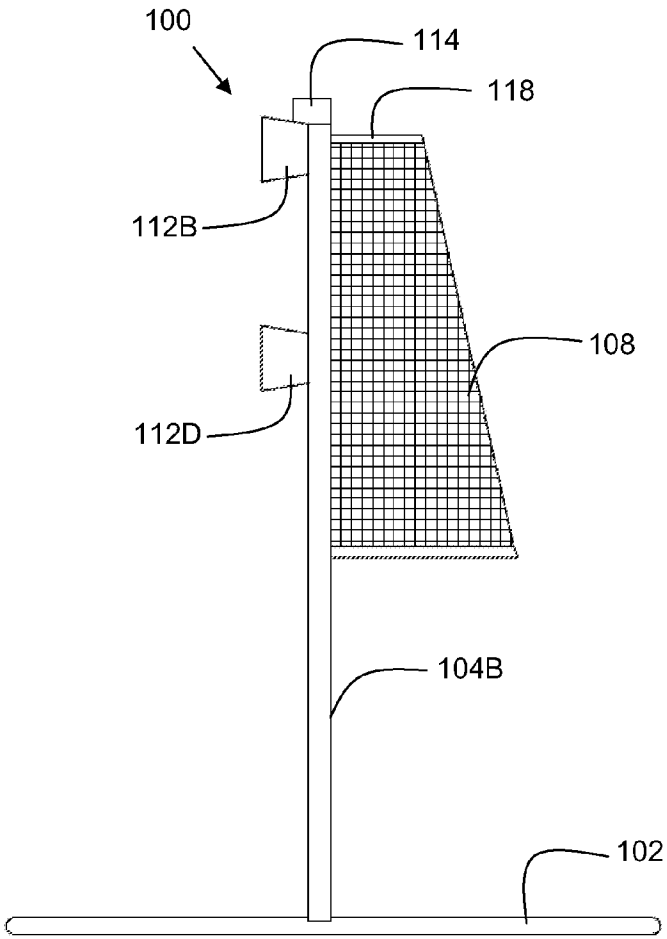
FIG. 4 shows a side view of an embodiment of the present invention.

FIG. 4 shows a side view of STA 100. In this view, net rail 118 is visible at the top of the net 108. Net rail 118 helps net 108 retain its shape, such that a ball thrown into net 108 will have a better chance of remaining in the net 108. Also shown in FIG. 4 are base 102, vertical member 104B, lights 112B and 112D, and target control module 114.

Figure 5A:
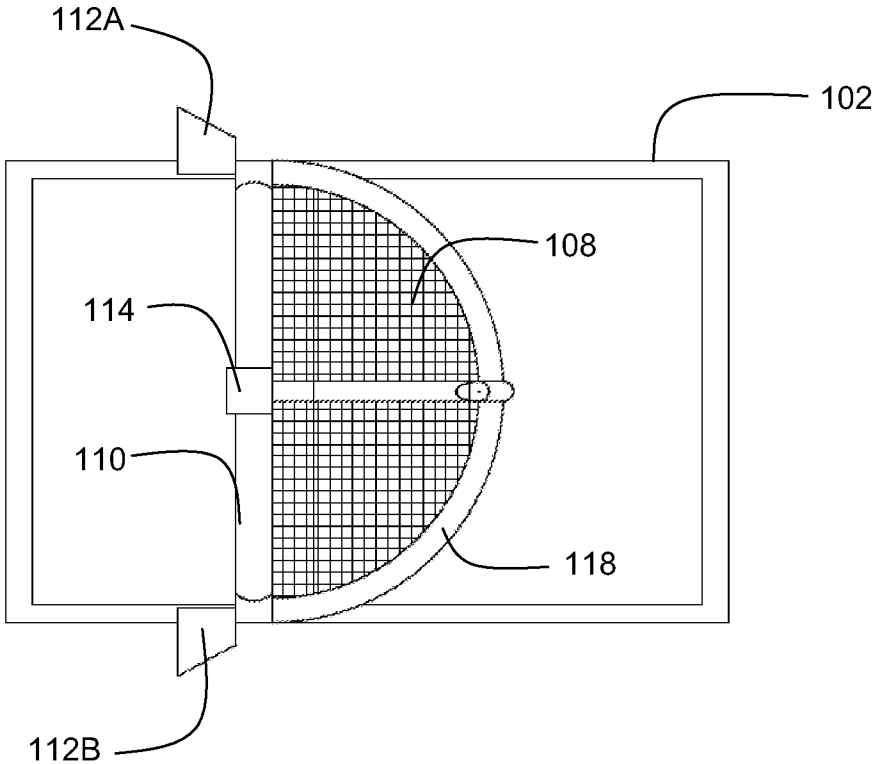
FIG. 5A shows a top-down view of an embodiment of the present invention.

FIG. 5A shows a top-down view of STA 100. In this view, net rail 118 is visible, and is of a semicircular shape. Also shown in FIG. 5A are base 102, upper spar 110, net 108, lights 112A and 112B, and target control module 114.

Figure 5B:
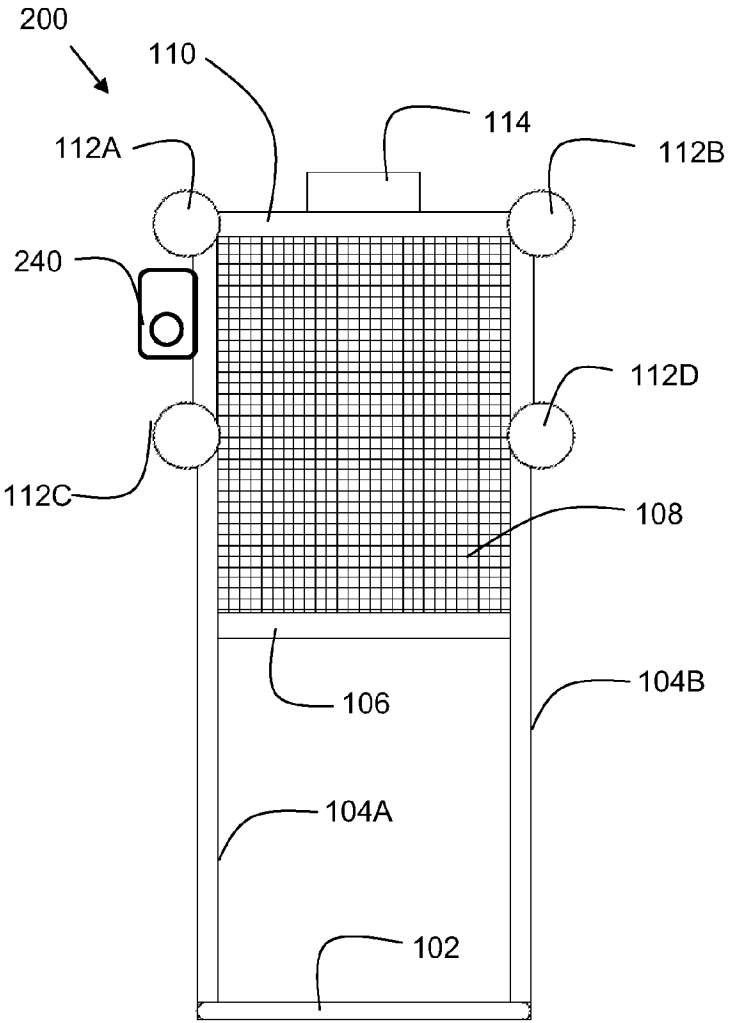
FIG. 5B shows a front view of an alternative embodiment of the present invention.

FIG. 5B shows a front view of an alternative embodiment of an STA 200. In this embodiment, an aural indicator 240, such as a speaker or buzzer is present. Aural indicator 240 may be configured to sound when a ball lands in net 108. Alternatively, aural indicator may be configured to generate a sound to indicate that the ball is to be thrown to that particular STA. In one embodiment, aural indicator may play audio samples that simulate speech utterances such as phrases heard during a real game. For example an audio sample might comprise the phrase "I'm open!" or "Over here!" to help develop an athlete's sense of directional sound as well as developing skills of scanning a playing field and developing throwing accuracy.

Also shown in FIG. 5B are base 102, vertical members 104A and 104B, lower spar 106, upper spar 110, lights 112A-112D, and target control module 114.

Figure 6:
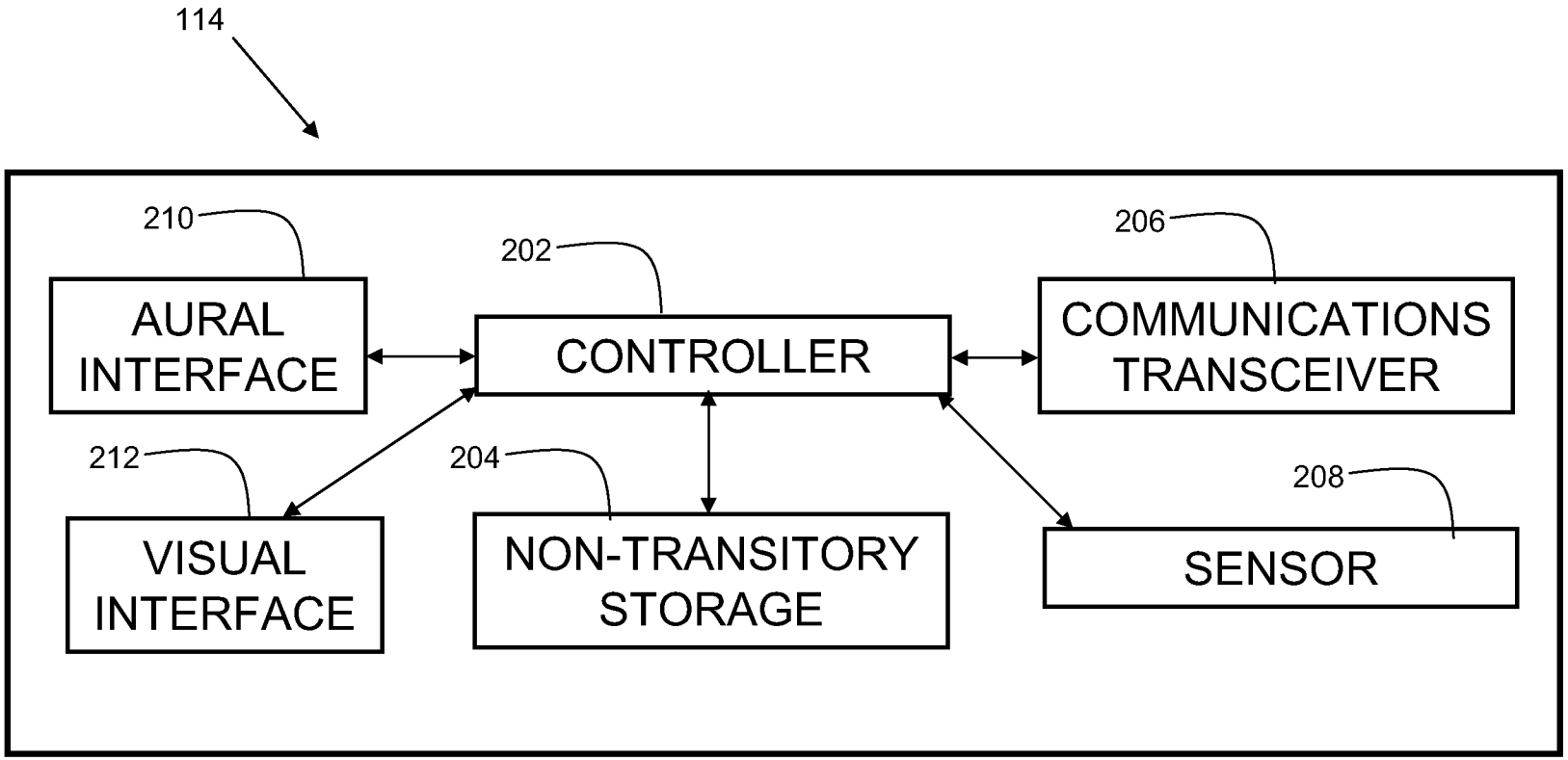
FIG. 6 shows a block diagram of an electronics module in accordance with an embodiment of the present invention.

FIG. 6 shows a block diagram of a target control module 114 in accordance with an embodiment of the present invention. Target control module 114 comprises controller 202, which may be a microprocessor or microcontroller. Non-transitory storage 204 may be implemented via machine-readable read only memory (ROM). Non-transitory storage 204 contains machine instructions, that when executed by controller 202, perform various functions of the sports training apparatus. Such functions may include interfacing with visual interface 212, which contains circuitry configured to activate lights 112A-112D (see FIG. 3). Optionally, aural interface 210 may be used to activate an aural indicator (see 240 of FIG. 5A). Sensor 208 may be used to detect the arrival of a ball in net 108 (see FIG. 1). This may be a motion sensor, an optical sensor, a vibration sensor, or other suitable sensor for detecting the arrival of a ball. Sensor 208 may also be referred to as a "detection module." In one embodiment, the STA indicates that the athlete is to throw the ball by illuminating all the lights 112A-112D for a duration ranging from 3 to 5 seconds. Then, once the ball is thrown into the net of the STA and detected by sensor 208, the lights 112A-112B will blink for positive reinforcement. In this way, the STA serves as a cognitive recognition apparatus.

Communications transceiver 206 may be used to allow a coach (204 of FIG. 2) to remotely control the STA device. In this way, the coach can activate a particular STA (see FIG. 2) to illuminate lights 112A-112D to signal the athlete 202 (FIG. 2) to throw the ball 207 into the illuminated STA. Communications transceiver 206 may communicate information though wires or is preferably a wireless transmitter utilizing radio frequency (RF) or infrared signaling. Storage 204 may also store audio samples for the purpose described for STA 200 shown in FIG. 5B.

In an alternative embodiment, controller 202 may also be configured to operated in a free-running mode, in which case controller 202 illuminates lights 112A-112D at a random interval. In this way, multiple STA 100 can be operated by an athlete alone, without the need for an additional operator such as coach 204.

Figure 7:
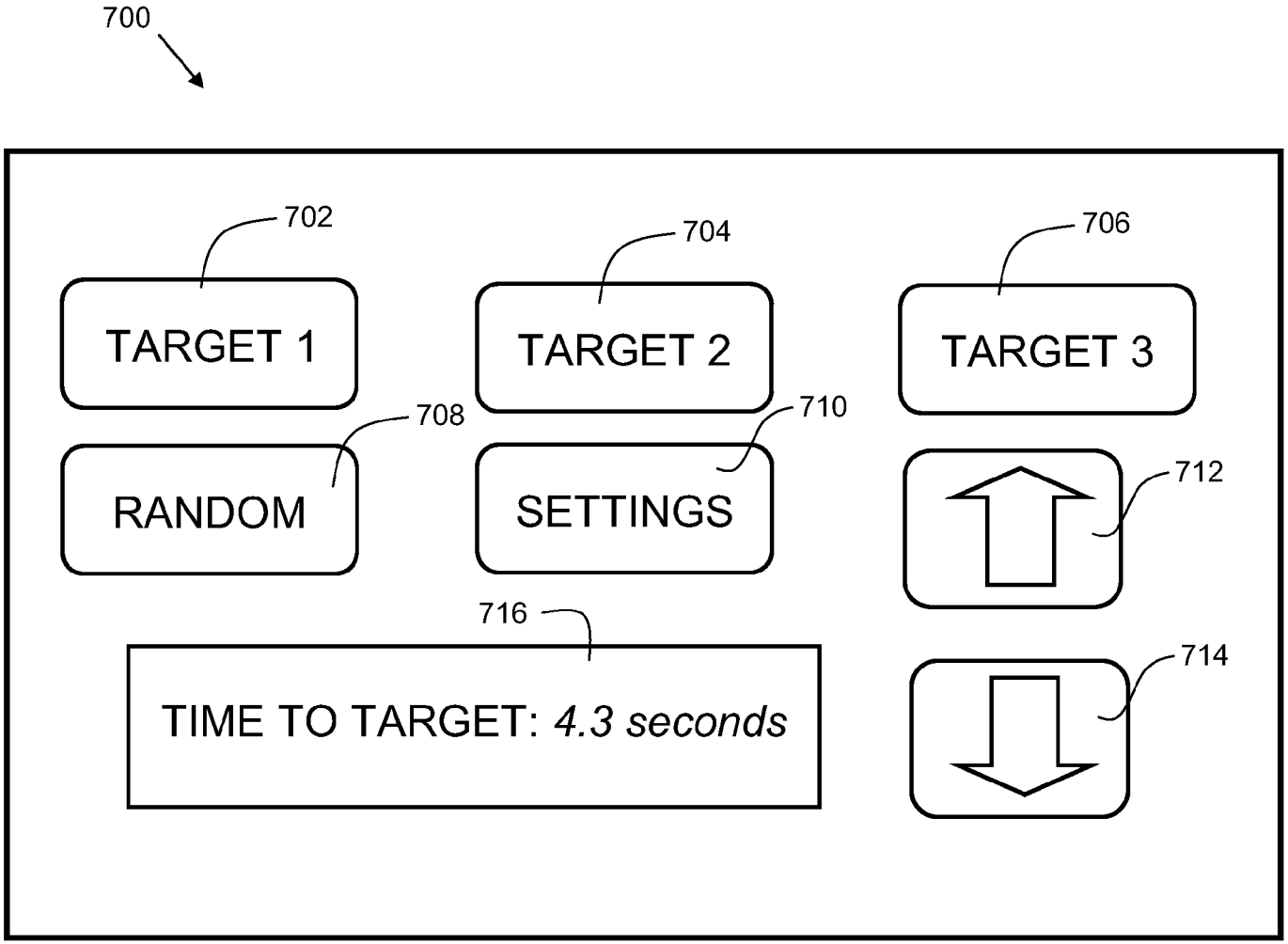
FIG. 7 is an activation control module in accordance with an embodiment of the present invention.

FIG. 7 is an activation control module 700 in accordance with an embodiment of the present invention. Activation control module 700 is preferably a wireless module that communicates with the plurality of STA 100 in use during a training session. In one embodiment, each STA 100 uses a different, predefined radio frequency. In another embodiment, each STA 100 is uniquely addressable via a unique identifier, such as a MAC address. Activation control module 700 comprises button 702 which activates a first STA, button 704 for activating a second STA, and button 706 for activating a third STA. Other embodiments of activation control module 700 may provide buttons for more than three STA. Random button 708 activates a random STA. Settings button 710 allows the user to edit and change various settings. Up button 712 and down button 714 allow navigation of menus and entering of options. Display 716 shows menu options. In one embodiment the user can enter a predetermined delay time via the settings. When a coach presses one of the target buttons, the corresponding STA is activated after the predetermined delay time elapses. In another embodiment, the STA communicates back to the activation control module 700 the time when the ball reached the target. In this way, the activation control module may display a "TIME TO TARGET" information field. The time-to-target value represents the time between when the STA was activated, and when the ball arrived at that target. Thus, performance statistics can be collected at each practice session to gauge improvement in the athlete. In one embodiment, the activation control module is implemented with software executing on a general purpose mobile computing device, such as a laptop computer or smart phone.

The device may also include a statistics tracker. The statistics tracker would include features that could recognize the length of time it took for the user (person throwing a ball) to recognize that a target is activated (in the preferred embodiment, the target lights up when activated) and track that statistic. It could also track how long it takes the user to hit the target from either the time the target is activated or the time the user recognizes the target or both, and how fast the ball is moving, typically measured in miles per hour. Additionally, the statistics tracker could track how many of the user's throws are successful in hitting the target. These data could then be stored and used as described above.

As can now be appreciated, embodiments of the present invention provide an improved system for training athletes such as football quarterbacks to prepare for real game play. Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed:

1. A sports training system, comprising:

a plurality of variably positionable target stations, each target station comprising a target support structure configured to support a vertically positioned target in a stationary position above a playing field, each target station comprising, a base, wherein the base has at least two support members extending vertically therefrom;

a vertically situated target having a net attached thereto, wherein the target is positioned between the support members and an upper spar and lower spar;

a net rail coupled to at least the net and the support members, the net rail extending perpendicularly from the support members, wherein the net rail provides support for the net and alters the position of the net;

a plurality of light sources, wherein the light sources are disposed on the support members, upper spar, and lower spar; and a controller, the controller configured and disposed to illuminate the light source;

a wirelessly activated target control module functionally connected to said target light;

an activation control module located remotely from said target stations and in wired or wireless communication with said target control module;

a detection module attached to each of said target stations, the detection module being functionally connected to the local wirelessly activated target light control module and to the activation control module; and wherein said activation control module and said target control modules are configured and programmed such that activating a button on the activation control module results in activating a randomly selected target light on a randomly selected target station.

2. The sports training system of claim 1, wherein said activation control module comprises a radio frequency transceiver.

3. The sports training system of claim 2, wherein the activation control module is further configured and programmed to receive an indication from at least one of the plurality of target stations when a ball is detected by the detection module.

4. The sports training system of claim 3, wherein the activation control module further comprises a display, the display configured and disposed to render an indication of a time-to-target value.

5. The sports training system of claim 3, wherein each target station further comprises an aural indicator, and wherein the target control module is configured and disposed to cause sound to be emitted from the aural indicator.

6. The sports training system of claim 5 wherein the aural indicator is a speaker.

7. The sports training system of claim 6, further comprising machine-readable storage, wherein the machine-readable storage contains audio samples representing speech utterances.

8. The sports training system of claim 1, further comprising a wireless receiver, the wireless receiver configured and disposed to receive commands and relay the commands to the controller.

9. The sports training system of claim 8, wherein the wireless receiver comprises an infrared receiver.

10. The sports training system of claim 8, wherein the wireless receiver comprises a radio frequency receiver.

11. The sports training system of claim 1 wherein said vertically situated target comprises a rectangular frame.

12. The sports training system of claim 1 wherein said activation control module is further configured and programmed such that activating a button on the activation control module results in activating a randomly selected target light on a randomly selected target station after a predefined delay.

13. The sports training system of claim 1, wherein said activation control module comprises an infrared transmitter.

14. The sports training system of claim 1 wherein said vertically situated target comprises a circular frame.

15. The sports training system of claim 1, further comprising a sensor, the sensor configured and disposed to detect the presence of a ball within the target area.

* * * * *